US008021132B2

(12) United States Patent
Green

(10) Patent No.: US 8,021,132 B2
(45) Date of Patent: Sep. 20, 2011

(54) PUMP INTAKE FOR ELECTRICAL SUBMERSIBLE PUMP

(75) Inventor: Demory S. Green, Broken Arrow, OK (US)

(73) Assignee: Baker Hughes Incorporated, Houston, TX (US)

( * ) Notice: Subject to any disclaimer, the term of this patent is extended or adjusted under 35 U.S.C. 154(b) by 693 days.

(21) Appl. No.: 12/029,762

(22) Filed: Feb. 12, 2008

(65) Prior Publication Data

US 2009/0202371 A1 Aug. 13, 2009

(51) Int. Cl.
*F04B 17/03* (2006.01)
*F04B 47/06* (2006.01)

(52) U.S. Cl. ..... 417/423.6; 417/360

(58) Field of Classification Search ..... 417/423.3, 417/423.6, 414, 360; 166/105, 105.3; 310/87
See application file for complete search history.

(56) References Cited

U.S. PATENT DOCUMENTS

| | | | | | |
|---|---|---|---|---|---|
| 2,693,760 | A | | 11/1954 | Miller | |
| 2,737,119 | A | * | 3/1956 | Hill | 417/326 |
| 3,126,831 | A | | 3/1964 | Deters | |
| 3,437,046 | A | * | 4/1969 | Lotspih et al. | 415/214.1 |
| 3,716,309 | A | | 2/1973 | Mitchell | |
| 3,853,430 | A | * | 12/1974 | O'Rourke | 417/360 |
| 4,386,653 | A | * | 6/1983 | Drake | 166/105 |
| 4,667,737 | A | * | 5/1987 | Shaw et al. | 166/104 |
| 4,877,371 | A | | 10/1989 | Putt | |
| 4,930,982 | A | | 6/1990 | Channell | |
| 5,659,214 | A | | 8/1997 | Guardiani et al. | |
| 5,954,483 | A | * | 9/1999 | Tetzlaff | 417/360 |
| 6,322,331 | B1 | * | 11/2001 | Swatek et al. | 417/360 |
| 6,698,521 | B2 | | 3/2004 | Schrenkel et al. | |
| 6,761,215 | B2 | | 7/2004 | Morrison et al. | |
| 6,840,324 | B2 | * | 1/2005 | Pettigrew | 166/369 |
| 6,868,912 | B2 | * | 3/2005 | Proctor | 166/378 |
| 6,883,604 | B2 | * | 4/2005 | Mack et al. | 166/105 |
| 7,325,601 | B2 | * | 2/2008 | Mack et al. | 166/105 |
| 7,445,429 | B2 | * | 11/2008 | Wilson et al. | 415/199.5 |
| 2003/0106687 | A1 | * | 6/2003 | Adams | 166/246 |
| 2004/0159442 | A1 | * | 8/2004 | Proctor | 166/378 |
| 2009/0010773 | A1 | * | 1/2009 | Parmeter et al. | 417/410.1 |

* cited by examiner

*Primary Examiner* — Devon C Kramer
*Assistant Examiner* — Nathan Zollinger
(74) *Attorney, Agent, or Firm* — Bracewell & Giuliani LLP

(57) ABSTRACT

An electrical submersible well pump assembly having a pump, a pump motor, a seal section, and an intake in the head of the seal section for drawing well bore fluid into the pump assembly. A shaft extends from the motor for driving the pump, a shaft coupling is included within the intake for connecting the shaft to the pump.

14 Claims, 2 Drawing Sheets

PUMP INTAKE FOR ELECTRICAL SUBMERSIBLE PUMP

FIELD OF THE INVENTION

This invention relates in general to electrical submersible well pumps, and in particular to connections between the seal section of the pump assembly and the pump.

BACKGROUND OF THE INVENTION

Electrical submersible well pumps are commonly used for hydrocarbon well production. A typical pump assembly has an electrical motor with a seal section or protector on its upper end. The motor is filled with a dielectric lubricant. The seal section has an equalizer in communication with that lubricant. The equalizer is also in fluid communication with the well bore fluid for equalizing the pressure of the lubricant to that of the well bore fluid. Typically the seal section will also have a thrust bearing for absorbing downward thrust from the pump.

The pumping assembly may comprise one or more pumps and optionally a gas separator. The pumps are rotary pumps driven by a shaft of the motor. They may be either progressing cavity pumps or they may be centrifugal pumps having a large number of stages, each stage having an impeller and a diffuser. If a gas separator is employed, typically it has a rotary gas separating component for separating gas from the well fluid prior to the well fluid entering the pump.

A different connector is required on the lower end of the pump depending upon whether the pump is to connect directly to a seal section or to another component of the pumping assembly, such as a gas separator or another pump. The connectors are not readily interchangeable between pumps, thus the manufacturer may be required to keep both types. The reason for having both types of pumps has to do with whether the connector has intake ports or not. If the pump is connecting to an upstream component such as another pump or a gas separator, its connector would not have intake ports. If connecting directly to the seal section, the connector would need intake ports.

Referring to FIG. 1 as further explanation of the prior art, pump 10 is a centrifugal pump having a number of stages, each stage having an impeller 12 and a diffuser 14. Pump 10 has a connector 16 on its lower end for connecting to other components of the pumping assembly. Connector 16 has external threads 18 that connect to internal threads in the housing of pump 10. Connector 16 has a flange 20 on its lower end containing a pattern of holes 22, each for receiving a bolt 24. Connector 16 does not have any intake ports leading directly to the exterior for drawing in well bore fluid. The reason is that pump 10 is constructed to be a middle or upper tandem pump or one for connection to a gas separator below it. In those instances, the intake ports would be in lower connector of the lower tandem pump or in the lower connector of the gas separator.

If the manufacturer wishes to use pump 10 without connecting it to an upstream component, such as another pump or gas separator, he can do so by connecting it to a separate intake housing 26. Intake housing 26 is a separate sub that has intake ports 28 for well fluid to pass inward and up to pump 10. Intake housing 26 has its own short shaft 30 (intake shaft) mounted therein and which connects to pump shaft 32 by a coupling 34. A radial bearing (or bushing) 36 supports intake shaft 30 in housing 26. Radial bearing 36 does not form a seal. A coupling on the lower end of intake housing shaft 30 will connect it to a seal section shaft (not shown). Intake housing 26 has a radial flange 38 for bolting to the seal section (not shown). While combining pump 10 with intake housing 26 allows a manufacturer to use pump 10 either as a middle or upper tandem pump or as a single pump without a gas separator, it requires extra expense because of intake housing 26.

SUMMARY OF THE INVENTION

Disclosed herein is a submersible pumping system for pumping wellbore fluid, comprising, a pump motor, an equalizing seal section coupled to the motor having a drive shaft driven by the pump motor, a top connector on the seal section, a pump assembly having a bottom connector and a drive shaft disposed through the bottom connector, an intake adaptor having a first end and a second end, wherein the first end is bolted to the seal section top connector and the second end is bolted to the pump bottom connector, a wellbore fluid intake formed through the intake adaptor in fluid communication with the pump inlet; and a coupling rotatably disposed in the intake adaptor, having an upper receptacle that mates with the pump drive shaft, and a lower receptacle that mates with the seal section drive shaft. The coupling is axially moveable relative to the adaptor and its upper end may extend into the pump bottom connector. Optionally, the coupling lower end may extend into the seal section top connector. The pumping system may further comprise a spring coaxially disposed in the coupling configured for contacting the seal section drive shaft thereby providing an upward force onto the coupling. An insert may be included in the lower portion of the coupling formed to receive the seal section drive shaft. In one embodiment, the coupling length exceeds the length of the adaptor.

Also disclosed herein is an electrical submersible pumping system for pumping wellbore fluids comprising a pump assembly having an inlet defined by an inlet connector with a flanged end, a pump intake adaptor comprising a body, a shaft coupling coaxially disposed in the body, a flanged exit bolted to the pump assembly suction, a flanged entrance end configured for bolting to an equalizing seal section, and a wellbore fluid intake in the body between the flanged entrance end and flanged exit end, the wellbore fluid intake being in fluid communication with the pump inlet, wherein the shaft coupling has a length greater than the length of the intake adaptor.

The present disclosure further includes a pump connector for coupling a middle or upper tandem pump within an electrical submersible pumping system to a seal equalizer, the pump connector comprising, a body having an axis for substantial alignment with the pumping system, a lower flange on the body configured for bolting attachment to a seal equalizer, an upper flange on the body configured for bolting attachment to the inlet of a pumping assembly, a wellbore fluid inlet formed through the body in fluid communication with the inlet of the pumping assembly, a bore formed axially through the body, and a shaft coupling disposed within the bore, the coupling having a first end and a second end with receptacles formed in each of the first and second ends configured to mate with respective drive members, the shaft coupling having an upper end that extends above the upper flange and a lower end that extends below the lower flange.

DETAILED DESCRIPTION OF THE INVENTION

Figure 2:
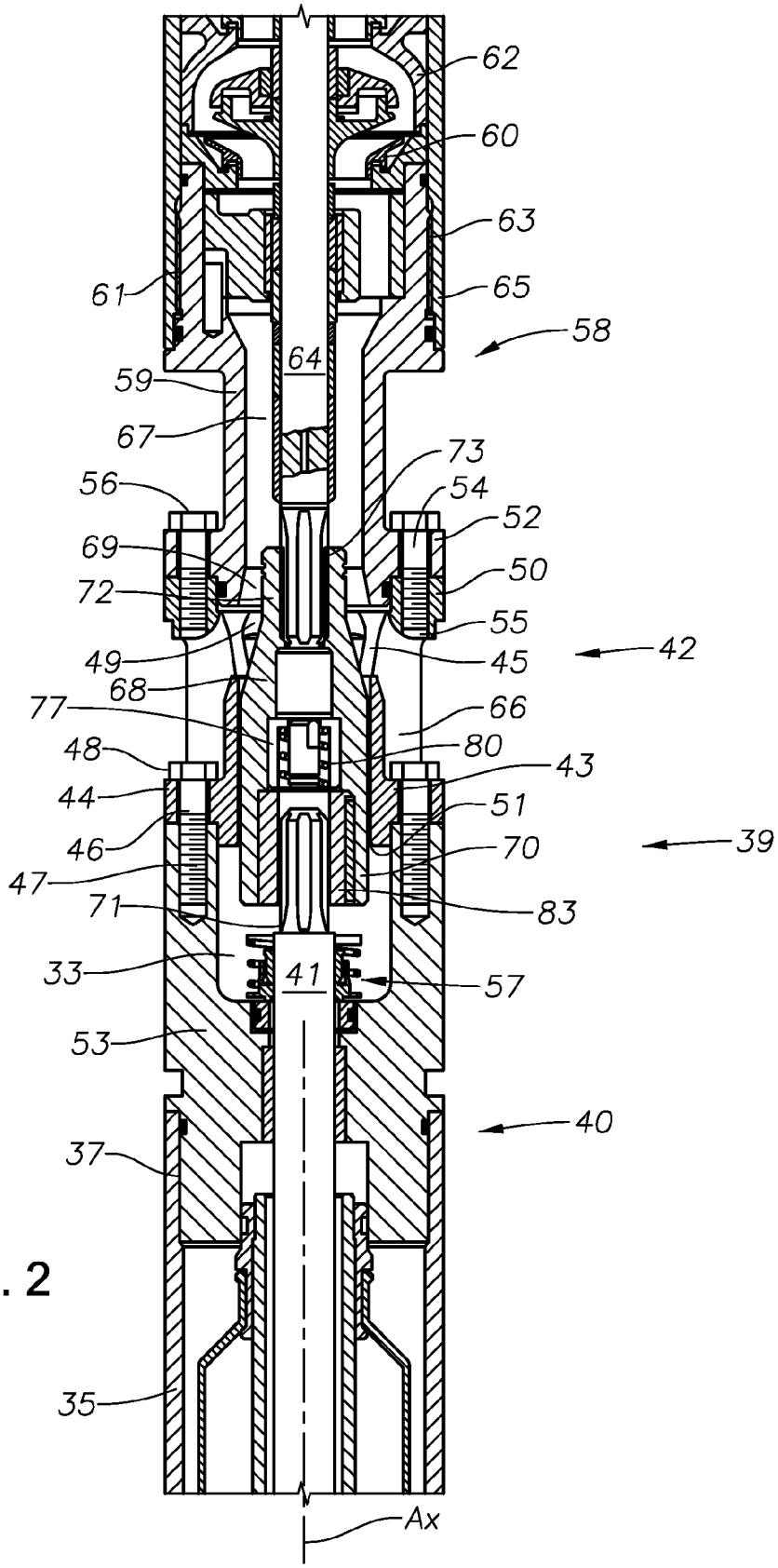
FIG. 2 is a vertical sectional view of a pump connector coupled between a pump and a seal section.

With reference now to FIG. 2, one example of a portion of an electrical submersible pump (ESP) system 39 shown in a vertical cross sectional view. This embodiment comprises a seal/equalizer section 40 whose upper end is connected to a submersible pump 58 by an intake adaptor 42. As its name suggests, the seal/equalizer section 40 provides an equalizing pressure within the motor of ESP 39 so when the pumping system is inserted within a wellbore, the hydrostatic pressure present in the wellbore will not create an undue pressure differential on any seals within the motor of ESP 39.

The intake adaptor 42 comprises a body 43, wherein the body includes a lower flange 44 with bolt holes 46 formed to correspond with bolt holes 47 formed in the head section 53 of the seal/equalizer 40. Threads 37 formed on the lower outer surface of the head section 53 provide connection for the head section 53 to the seal housing 35. A bolt 48 is shown inserted within bolt hole 46 and extending into bolt hole 47 for boltingly securing the intake adaptor 42 to the seal/equalizer 40. The pump 58 includes a connector 59 attached on its lower end configured similarly to the prior art connector 16 of FIG. 1. The connector 59 is a generally annular member having threads 61 formed on a portion of its outer periphery for attachment to corresponding threads 63 on the inner circumference of the pump housing 65. The intake adaptor 42 body 43 further comprises an upper flange 50 with bolt holes 55 configured to mate with bolt holes 54 provided in a lower flange 52 of the pump connector 59. A bolt 56 is shown extending through bolt holes 54 and into bolt hole 55 for bolting engagement of the pump 58 with the intake adaptor 42.

The body 43 further includes an annular bore 51 generally coaxial with the axis AX of the ESP 39. A coupling 68 is shown extending through the bore 51. In the embodiment shown, the coupling 68 is longer than the body 43. The coupling 68 includes a lower end 70 having a hollowed out portion fitted with an insert 83. The insert 83 is anchored within the coupling 68 to prevent rotation of the insert 83 within the coupling 68. The insert 83 includes a receptacle 71 formed therein for receiving and engaging a drive shaft 41 shown extending upward from the seal section 40. The upper end of the shaft 41 has generally splined striations and accordingly the receptacle 71 will have striations formed therein to couplingly receive the upper end of the shaft 41 so that rotational force from the shaft is transmitted onto the coupling 68. However, the form of coupling is not limited to the splined shaft as shown but can include other shapes and configurations, such as shafts having an end whose cross sectional shape resembles rectangles or other similar shapes with a corresponding shaped receptacle 71.

The insert 83 provides flexibility for attaching seals 40 having varying sizes of shafts 41, changing the insert 83 provides ready coupling of different sized shafts 41. A spring 80 is affixed in the middle portion 77 of the bore 51 where the bottom portion of the spring 80 contacts the shaft 41. This upwardly urges the coupling 68 and facilitates alignment of the coupling 68 with the pump shaft 64. For example, if the coupling 68 is first placed mated with the equalizer shaft 41 it rests thereon due to gravity. The pump 68 is then lowered for engaging the pump shaft 64 with the upper receptacle 73. However it is likely the respective splines of the shaft 64 and receptacle 73 will not initially be aligned. Mechanical connectivity between the coupling 68 and both shafts (41, 64) can be maintained due to the spring 80 while the pump shaft 64 is rotated. When the splines are aligned, the coupling 68 will slide onto the pump shaft 64 upwardly urged by the spring 80. Prior to attaching the coupling 68, the housing 43 can be bolted to either the pump connector 59 or the head section 53. After the coupling 68 is properly aligned with both shafts (41, 64), the remaining bolts can be secured to the housing 43.

The shaft 41 receives rotational force from a pump motor (not shown) that is a part of the ESP system 39. The coupling 68 also has an upper end 72 formed for engagement with a shaft 64 that extends into the pump 58. The upper end 72 includes a receptacle 73 formed within the upper end 72 and configured to engage the tip portion of the shaft 64. As with the receptacle 71 of the lower end 70, the configuration and shape of the receptacle 73 is not limited to a splined shape but can take on any form suitable for transmitting rotational force or energy. Thus the coupling 68 provides rotational transfer of force from the pump motor, via the seal section 40 and onto the pump 58. A rotational force imparted onto the pump 58 via the shaft 64 is used for rotating impellers 60 located within the pump body 58. As is known the cooperation between rotating impellers and corresponding diffusers 62 provides a pressurizing force on wellbore liquid produced by the pump 58.

The coupling 68 rotates within the body 43 of the adaptor 42 without contacting the body 43. Well fluid may enter into the clearance between the coupling 68 and the body 43 thereby providing lubrication between these two moving parts. A cavity 33 formed in the head section 53 may collect with well fluid flowing between the coupling 68 and body 43. A mechanical seal 57 is provided around the seal shaft 41 thereby preventing well fluid from flowing into the seal/equalizer 40.

The adaptor 42 further comprises an intake 66 for drawing in wellbore fluid to be produced by the pump 58. Thus fluid within the wellbore would pass through the intake 66 upwards along the contoured intake of the intake adaptor 42 and through passages 49 formed between web members 45. The web members 45 extend from the upper portion of the body 43 to the upper flange 50. The pump connector 59 includes an annular inlet 67 between its housing and the pump shaft 64 for guiding wellbore fluid to the pump impellers 60. Additional passages 69 are provided in the pump connector 59 that provide fluid communication between the passages 49 and the annular inlet 67.

Figure 1:
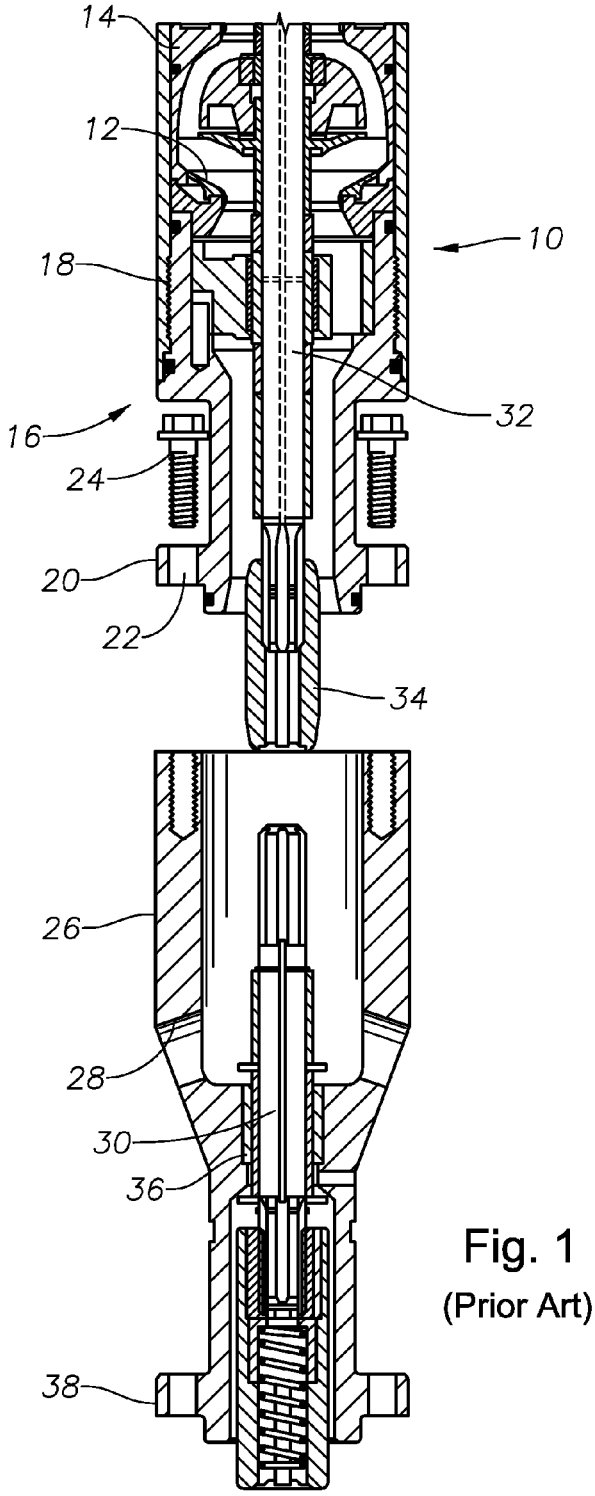
Fig. 1 (Prior Art)
FIG. 1 is an exploded sectional view of one prior art type of pump connector and an intake sub.

Thus one of the advantages of the device disclosed herein is its ability to convert a middle or upper tandem pump into a stand-alone pump. As is known a middle or upper tandem pump is typically used in conjunction with other upstream pumps and thus will typically not include an intake portion or a means of connecting the pump to either a seal section or a gas separator. A vendor or manufacturer may have many middle or upper tandem pumps on hand but may not have a stand-alone pump that can be readily connected to a seal section or a gas liquid separator. The connection on the middle or upper tandem pumps would include intake ports. The adaptor described herein therefore allows a middle or upper tandem pump to be used as a stand-alone pump. Optionally a middle or upper tandem pump could be used in conjunction with the intake adaptor 42 in lieu of any currently produced stand-alone pump. A separate shaft 30 as in the prior art in the intake housing 26 of FIG. 1 is not required, thus reducing cost.

Figure 3:
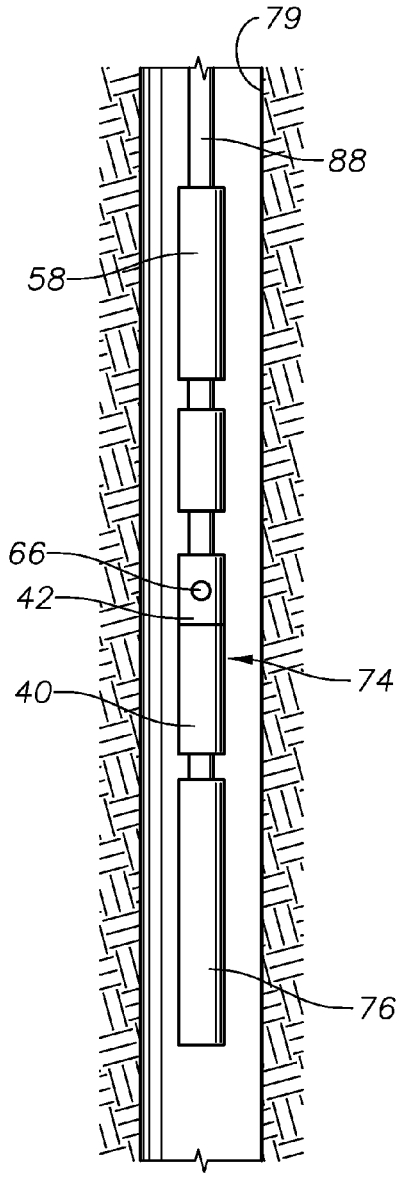
FIG. 3 is a schematic view of an electrical submersible pumping assembly constructed in accordance with this invention.

FIG. 3 provides an example of an alternative ESP system 74 used in a cased wellbore 79. Here the system 74 is disposed within the wellbore 79 on production tubing 88. The system includes a pump motor 76 mechanically coupled to a seal equalizer section 40 on its upper end. Thus the connector 42 as disclosed herein is coupled between the upper portion of the seal equalizer section 40 and the connector of pump 58. Intake port 66 is shown for providing fluid communication from within the wellbore 79 to the pump 86.

While the invention has been shown in only one of its forms, it should be apparent to those skilled in the art that it is not so limited but is susceptible to various changes without departing from the scope of the invention.

The invention claimed is:

1. A submersible pumping system for pumping wellbore fluid, comprising:

a pump motor;

an equalizing seal section having a seal section drive shaft driven by the pump motor and;

an annular top connector having an end threadingly connected to an end of the seal section;

a pump assembly;

an annular bottom connector having an end threadingly connected to an end of the pump assembly;

a pump drive shaft coupled to the pump assembly and extending through the bottom connector;

an intake adaptor having an end bolted to the top connector and another end bolted to the bottom connector;

a wellbore fluid intake formed through the intake adaptor in fluid communication with the pump inlet; and a coupling rotatably disposed in the intake adaptor, having an upper receptacle that mates with the pump drive shaft, and a lower receptacle that mates with the seal section drive shaft.

2. The pumping system of claim 1, wherein the intake adaptor has an outer wall comprising a portion of an outer surface of the pumping system.

3. The pumping system of claim 1 wherein the upper end of the coupling extends into the pump bottom connector.

4. The pumping system of claim 1 wherein the lower end of the coupling extends into the seal section top connector.

5. The pumping system of claim 1, further comprising a spring coaxially disposed in the coupling configured for contacting the seal section drive shaft thereby providing an upward force onto the coupling.

6. The pumping system of claim 1 further comprising an insert disposed in the lower portion of the coupling formed to receive the seal section drive shaft and having a selectively varying size for receiving drive shafts that range in size.

7. The pumping system of claim 1, wherein the intake adapter bolt holes for connection to the annular top connector, an upper body portion having a flange with bolt holes for connection to the annular bottom connector lower body portions, and passages formed between the web members comprising the wellbore fluid intake.

8. The pumping system of claim 1, wherein the coupling length exceeds the length of the adaptor.

9. The pumping system of claim 1, wherein the coupling is free of attachment to the body.

10. An electrical submersible pumping system for pumping wellbore fluids comprising:

a pump assembly having an inlet defined by an inlet connector with a flanged end;

a pump intake adaptor having a body with flanged connections at opposing ends of the body;

a shaft coupling coaxially disposed in the body and extending past the opposing ends of the body;

an annular bottom connector having an end threaded for connection to a pump section;

an annular upper connector having an end threaded for connection to an end of a seal section; and a wellbore fluid intake in the body between the flanged ends and in fluid communication with a pump inlet on the pump section.

11. The pumping system of claim 10, wherein the shaft coupling comprises an elongated member with female fittings formed in each of the opposing ends of the body that are configured for mechanical coupling with drive shafts insertable within the ends.

12. The pumping system of claim 10 wherein an end of the shaft coupling extends into the pump section.

13. The pumping system of claim 10, wherein an end of the shaft coupling extends into the seal section.

14. The pumping system of claim 10, further comprising a spring coaxially disposed in the shaft coupling and a drive shaft in the seal section, wherein the spring is configured for contacting the drive shaft in the seal section thereby providing an upward force onto the coupling.

* * * * *

UNITED STATES PATENT AND TRADEMARK OFFICE

CERTIFICATE OF CORRECTION

PATENT NO. : 8,021,132 B2
APPLICATION NO. : 12/029762
DATED : September 20, 2011
INVENTOR(S) : Demory S. Green It is certified that error appears in the above-identified patent and that said Letters Patent is hereby corrected as shown below:

COVER PAGE - item (57) ABSTRACT:

line 5, delete "," after "pump" and insert --.--
line 5, delete "a shaft" and insert --A shaft--

Column 4, line 31, delete "with" before "well fluid"

Signed and Sealed this
Twenty-ninth Day of November, 2011

David J. Kappos

David J. Kappos
*Director of the United States Patent and Trademark Office*